US006170133B1

(12) United States Patent
Uehara

(10) Patent No.: US 6,170,133 B1
(45) Date of Patent: Jan. 9, 2001

(54) BUCKLE

(75) Inventor: Ryoichiro Uehara, Toyama-ken (JP)

(73) Assignee: YKK Corporation, Tokyo (JP)

( * ) Notice: Under 35 U.S.C. 154(b), the term of this patent shall be extended for 0 days.

(21) Appl. No.: 09/256,077

(22) Filed: Feb. 26, 1999

(30) Foreign Application Priority Data

Mar. 20, 1998 (JP) ..... 10-092441

(51) Int. Cl.[7] ..... A44B 11/25

(52) U.S. Cl. ..... 24/614; 24/615; 24/633; 24/634; 24/656

(58) Field of Search ..... 24/614, 615, 656, 24/633, 642, 634, 625

(56) References Cited

U.S. PATENT DOCUMENTS

| | | | | |
|---|---|---|---|---|
| 3,522,640 | | 8/1970 | Lohr . | |
| 5,113,556 | * | 5/1992 | Murai et al. | 24/633 |
| 5,542,161 | * | 8/1996 | Anscher | 24/614 |
| 5,551,131 | * | 9/1996 | Anscher | 24/614 |
| 5,659,931 | * | 8/1997 | Anscher | 24/614 |
| 5,709,014 | | 1/1998 | Takahashi . | |

FOREIGN PATENT DOCUMENTS

| | | |
|---|---|---|
| 0 492 221 | 7/1992 | (EP) . |
| 0 681 793 | 11/1995 | (EP) . |

OTHER PUBLICATIONS

Patent Abstracts of Japan, publication No. 07246106, vol. 096, No. 001 (1 page), Sep. 26, 1995.
Patent Abstracts of Japan, publication No. 08089314, vol. 096, No. 008 (1 page), Apr. 9, 1996.

* cited by examiner

*Primary Examiner*—Victor N. Sakran
(74) *Attorney, Agent, or Firm*—Finnegan, Henderson, Farabow, Garrett & Dunner, L.L.P.

(57) ABSTRACT

The present invention provides a buckle having a desirable operability wherein a pair of plugs are simultaneously engaged and disengaged from a socket by a simple structure. The buckle comprises a pair of plugs and a socket. Each the plug has a tongue portion to be inserted into the socket and an engaging portion formed at a tip end portion of the tongue portion. The socket is formed with inserting portions into which the tongue portions are inserted respectively, fixed engaged portions which are formed in the inserting portions and with which the engaging portions of the plugs are engaged, and an operating portion which is formed between the engaged portions and which displaces the engaging portions to disengage the engaging portions with the engaged portions. The operating portion comprises an operating chip exposed to an outer surface of the socket, pushing portions integrally formed on a rear face side of the operating chip, and a pair of resilient portions which extend from the operating chip, integrally extend from a rear face side of the socket toward insides of the inserting portions, and are disposed symmetrically with respect to the operating chip.

4 Claims, 5 Drawing Sheets

BUCKLE

BACKGROUND OF THE INVENTION

1. Field of the Invention

The present invention relates to a buckle having three-way strap and used for securing a human body and the like.

2. Description of the Related Art

Conventionally, a buckle mounted to each coupling end portion of a three-way strap comprises a pair of plugs and a socket into which the pair of plugs are inserted and engaged with. An operating portion for resiliently deforming the engaged buckle to disengagement is mounted to the socket. For example, a buckle disclosed in Japanese Patent Application Laid-open Publication No. 7-246106 has a hinge portion which is a resilient portion formed integrally with an upper face of the socket, and a lock canceling button which is an operating portion is defined at a tip end of the hinge portion in a cantilevered state. A through hole is defined on a bottom face of the socket and corresponds to a position of the lock canceling button.

In a buckle disclosed in Japanese Patent Application Laid-open Publication No. 8-140712 of the same applicant as that of the present invention, a resilient portion is mounted from an inner side of a bottom face of a socket to extend diagonally toward an upper face of the socket in a cantilevered state, and an operating portion is mounted to a tip end of the resilient portion.

There is also a coupling device disclosed in Japanese Patent Application Laid-open Publication No. 8-89314, wherein a lock member which is an operating portion is separated from a socket. In this device, two resilient leg portions projecting diagonally and downward are formed at a bottom face of the lock member to abut on an inner side face of a bottom face of the socket, and the lock member is supported for projecting and sinking movements.

An operation of the buckle disclosed in each the above Japanese patent application laid-open publication is reliably carried out by inserting the plugs into inserting holes of the socket and pushing the plugs against a resilient force generated at the engagement. In order to pull the plugs out of the socket, the operating portion such as a lock canceling button of the socket is pushed. Thus, the engagements between engaged portions of the plugs and the socket are disengaged, thereby the pair of plugs can be pulled out of the socket.

In the case of the technique disclosed in above Japanese Patent Application Laid-open Publication No. 7-246106, because the through hole is defined on the rear face of the socket and which corresponds to the position of the lock canceling button, clothes or a finger may be caught on the lock canceling button, and the buckle is inconvenient to use. The lock canceling button is not sufficiently strong due to its cantilevered structure. Also, clothes or other members may be inserted and caught in the through hole which corresponds to the position of the lock canceling button, and thus, the lock canceling button may be stripped off and broken. In the case of the technique disclosed in Japanese Patent Application Laid-open Publication No. 8-140712, by pushing the operating chip of the operating portion, the pair of plugs are disengaged and the plugs jump out of the socket. Because the operating chip is supported by a resilient portion in a cantilevered state, displacement of the operating chip opposite to the resilient portion is liable to increase. Therefore, due to an operation of the operating chip, the plug inserted to an opposite side to the resilient portion is liable to be disengaged faster. As a result, there were differences in amounts of jumping out of the plugs and feelings at the time of the disengagement. In addition, the operating chip is not sufficiently strong due to its cantilevered state, and the operating chip may be stripped off similarly to the above Japanese patent application laid-open publication. In the technique disclosed in Japanese Patent Application Laid-open Publication No. 8-89314, both sides of the lock member can be evenly displaced by a pair of resilient leg portions. However, the lock member is formed independently, thereby increasing a number of parts and complicating the structure.

SUMMARY OF THE INVENTION

The present invention has been accomplished with the above prior art in view, and it is an object of the invention to provide a buckle with a desirable operability, wherein engagements of a pair of plugs with a socket are disengaged simultaneously by a simple structure.

To solve the above object, according to the invention, there is provided a buckle comprising a pair of plugs respectively mounted to end portions of a pair of straps, a socket mounted to an end portion of another strap, a strap mounting portion formed at a base portion of each of the plugs, a tongue portion formed to project from the strap mounting portion and to be inserted into the socket, an engaging portion formed at a tip end portion of the tongue portion, a pair of inserting portions which are formed in the socket to penetrate the socket and to face each other and into which the tongue portions are inserted respectively, fixed engaged portions which are formed in the inserting portions and with which the engaging portions of the plugs are engaged, and an operating portion which is formed between the engaged portions and which displaces the engaging portions to disengage the engaging portions with the engaged portions.

The operating portion comprises an operating chip exposed to an outer surface of the socket, pushing portions integrally formed on a rear face side of the operating chip, and a pair of resilient portions which extend from the operating chip, integrally extend from a rear face side of the socket toward insides of the inserting portions, and are disposed symmetrically with respect to the operating chip. The pair of resilient portions are stick-shaped and disposed on a straight line, end portions of the resilient portions which face each other are continuously formed to be connected to the operating chip, and other end portions of the resilient portions are continuously formed to be connected to a rear face of the socket. The socket is defined in a vicinity of the resilient portions with through holes slightly larger than the resilient portions and is defined at side edge portions of the through holes with gentle projections. The socket is defined with an operating hole into which the operating portion is fitted, and the operating portion is defined at an end portion thereof with an L-shaped engaging projection to be locked on a side edge portion of the through hole.

In the buckle of the invention, because the operating chip is supported by the resilient portions having both-end supported structures and because the resilient portions are disposed symmetrically with respect to the operating chip, displacements when the operating chip is pushed are even, and tongue portions of the pair of plugs are pushed substantially simultaneously with the same force and are resiliently deformed similarly to each other. Thus, the engaging portions of the tongue portions are released from the engaged portions of the socket, to be disengaged. Because the tip end portions of the tongue portions are pushed by the pushing portions of the operating portion at this time, a force for pushing the plugs out of the socket is applied, and the pair of plugs jump out of the socket substantially simultaneously.

DESCRIPTION OF THE PREFERRED EMBODIMENT

Figure 2:
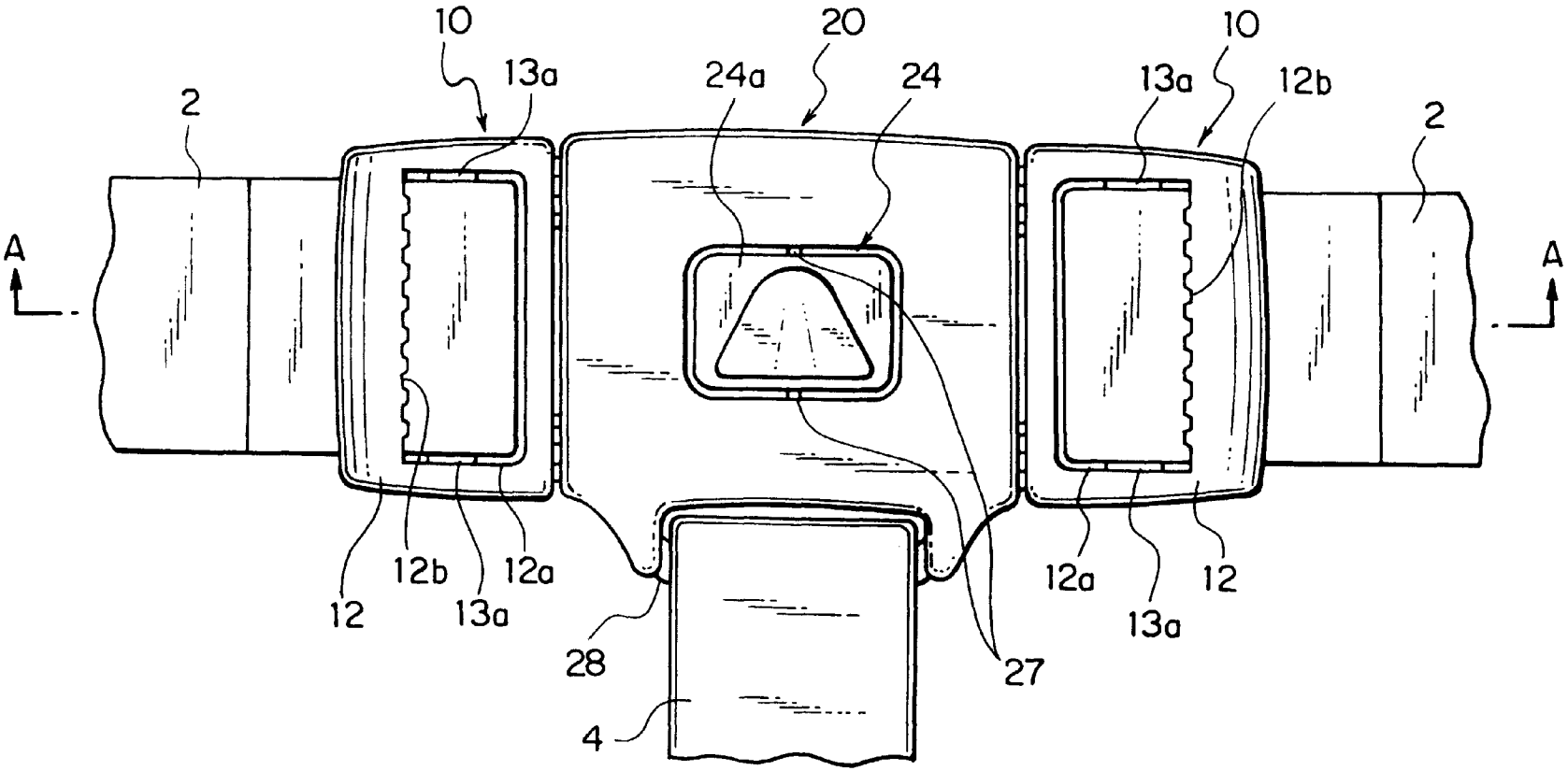
FIG. 2 is a plan view of the buckle of the embodiment in a state wherein plugs and a socket are coupled.
Figure 3:
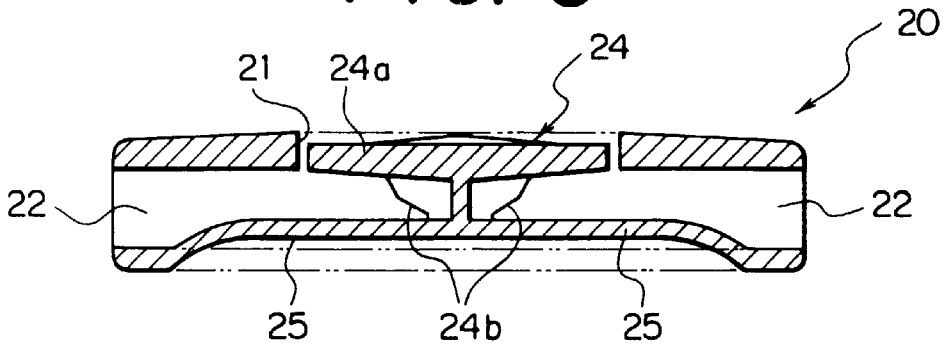
FIG. 3 is a sectional view of the socket taken along a line A—A in FIG. 2.
Figure 4:
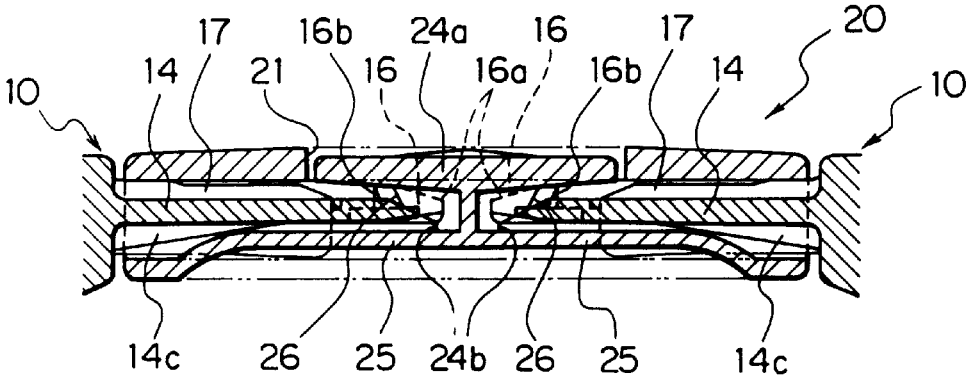
FIG. 4 is a sectional view of the buckle taken along a line A—A in FIG. 2 and in a state wherein the plugs are inserted into the socket.

An embodiment of the present invention will be described below based on the drawings. A buckle of the embodiment is a sheet belt of a vehicle and the like which is used for securing a human body. As shown in FIG. 2, the buckle comprises a pair of plugs 10 which are made of resin and are respectively mounted to tip ends of a pair of straps 2 of the three-way straps of three-point support and a socket 20 made of resin which is mounted to the other strap 4 and into which the plugs 10 are inserted and coupled. Each of the plugs 10 is integrally defined with a flat tongue portion 14 projecting from a strap mounting portion 12 at a base portion of the plug 10 and with a pair of support portions 17 projecting along notch portions 15 on opposite side portions of the tongue portion 14. A pair of upper faces 16*a* which slightly project upward and perpendicularly to a projecting direction of the tongue portion 14 and which slope down in an inserting direction of the tongue portion 14 into the socket 20 and a pair of engaging portions 16 having predetermined length each of which is connected to the upper face 16*a* and has an engaging face 16*b* formed on a base end portion side of the tongue portion 14 are formed on a front face side of a tip end portion of the tongue portion 14 to extend from the opposite side portions toward a center portion of the tongue portion 14. The upper faces 16*a* of the engaging portions 16 slope down in the inserting direction in a wedge shape, and the engaging faces 16*b* slope down from the upper face sides toward the tip end portion of the tongue portion 14.

Each of the support portions 17 on opposite sides of the tongue portion 14 is defined at a center portion thereof with a long and narrow through hole 18. A width of the support portions 17 in a direction perpendicular to the inserting direction is substantially equal to a width of a gap of inserting portions 22 of the socket 20. A recessed groove (not shown) which functions as a sliding portion to be guided to the socket side at the time of insertion is defined on a rear face side of each the support portion 17. A pair of triangular ribs 14*c* for reinforcement are formed near to the opposite sides of a rear face side of the tongue portion 14 at a boundary portion between the base end portion of the tongue portion 14 and the strap mounting portion 12.

The strap mounting portion 12 of each the plug 10 slopes down toward a rear face side of the socket 20 with 23 degrees relative to an extending direction of the strap 2. The strap mounting portion 12 of the plug 10 is defined with a mounting hole 12*a* into which a tip end portion of the strap 2 is inserted and a clamping portion 13 available for reciprocating and swinging movements in a predetermined range of the mounting hole 12*a*. Opposite end portions 13*a* of the clamping portion 13 are loosely fitted to elongated holes 12*c* defined in side faces of the mounting hole 12*a*. Each of the opposite end portions 13*a* of the clamping portion 13 is formed in a size of that the opposite end portion 13*a* can move reciprocally by a predetermined distance and is in a sectional ellipse shape such that the opposite end portion 13*a* can swing through a predetermined angle in the elongated hole 12*c*. An end portion of the mounting hole 12*a* in the extending direction of the strap 2 is defined with a serrated portion 12*b* which bites the strap 2. The clamping portion 13 which faces the serrated portion 12*b* is defined at an end face of the clamping portion 13 with a similar serrated portion 13*b*. The clamping portion 13 is in a sectional rhomb shape, and acute angles of the rhomb are able to abut on an inner side face of the mounting hole 12*a* in the mounting hole 12*a*.

The socket 20 is in a flat and hollow cylindrical shape. The hollow portions of the socket 20 are the inserting portions 22 for the plugs 10. A guide projecting streak 23 as a guide portion for guiding the plugs 10 is formed on an inner face of a rear face side of the inserting portions 22 in the inserting direction of the tongue portions 14. An operating portion 24 is formed at a center portion of the socket 20. The operating portion 24 is positioned in an operating hole 21 defined on an outer front face side of the socket 20. The operating portion 24 comprises an operating chip 24*a* which is exposed to the outside and pushing portions 24*b* which are integrally formed on the rear face side of the operating chip 24*a*, and which face each other to push the tongue portions 14 of the pair of plugs 10 downward. L-shaped engaging projections 27 which abut on inner sides of side edge portions of the operating hole 21 of the socket 20 are formed on opposed side edge portions of the operating chip 24*a*. Two pairs of pushing portions 24*b* are formed at positions where the pushing portions 24*b* abut on the tip end portions 14*a* of the tongue portions 14. A pair of resilient portions 25 which extend from the operating chip 24*a* toward the rear face side and integrally extend from side faces on the rear face side of the socket 20 toward insides of the inserting portions 22 of the socket 20 are formed integrally with the operating portion 24.

The resilient portions 25 are in stick shapes and disposed on a straight line which is parallel to the inserting portions 22. Opposed end portions of the respective resilient portions 25 which are stick-shaped and disposed on a straight line, are connected to the operating portion 24, and the other end portions are connected to the socket 20. Therefore, the resilient portions 25 are symmetric with each other with respect to the operating chip 24*a*, and the two pairs of resilient portions 25 are in an both-end supported structure. A through hole 25*a* is defined on the rear face side of the socket 20 where the resilient portions 25 extend such that the resilient portions 25 can swing. Projections 29 each having a gentle slope with a large width are formed along the through hole 25*a* at opposite side edge portions of the through hole 25*a*.

Figure 7:
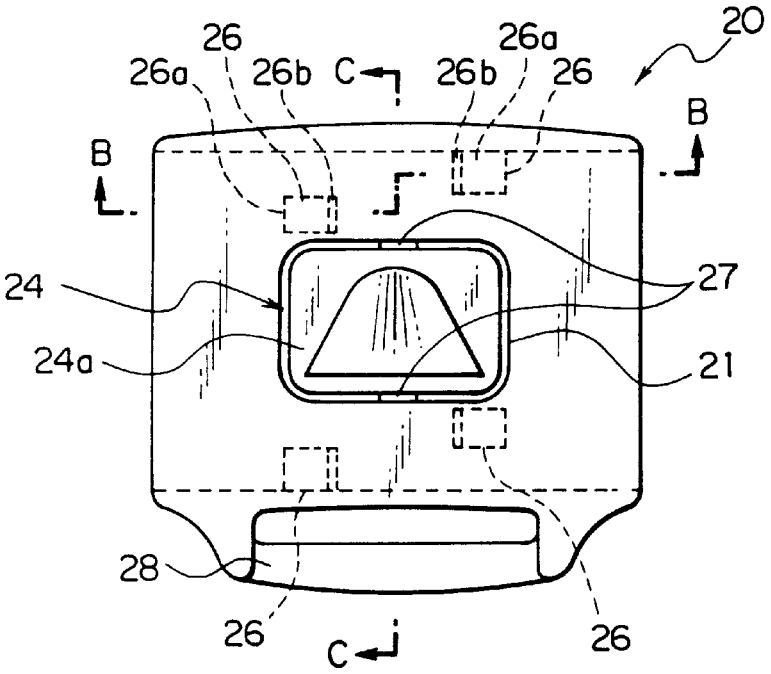
FIG. 7 is a plan view of the socket of the embodiment.
Figure 8:
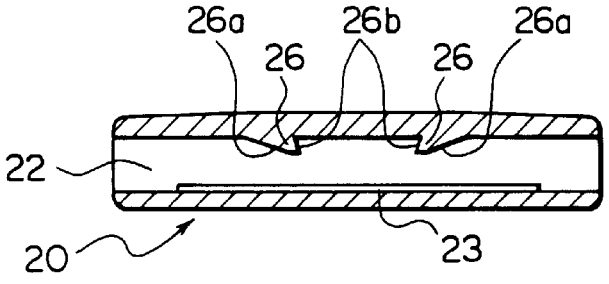
FIG. 8 is a sectional view taken along a line B—B in FIG. 7.
Figure 9:
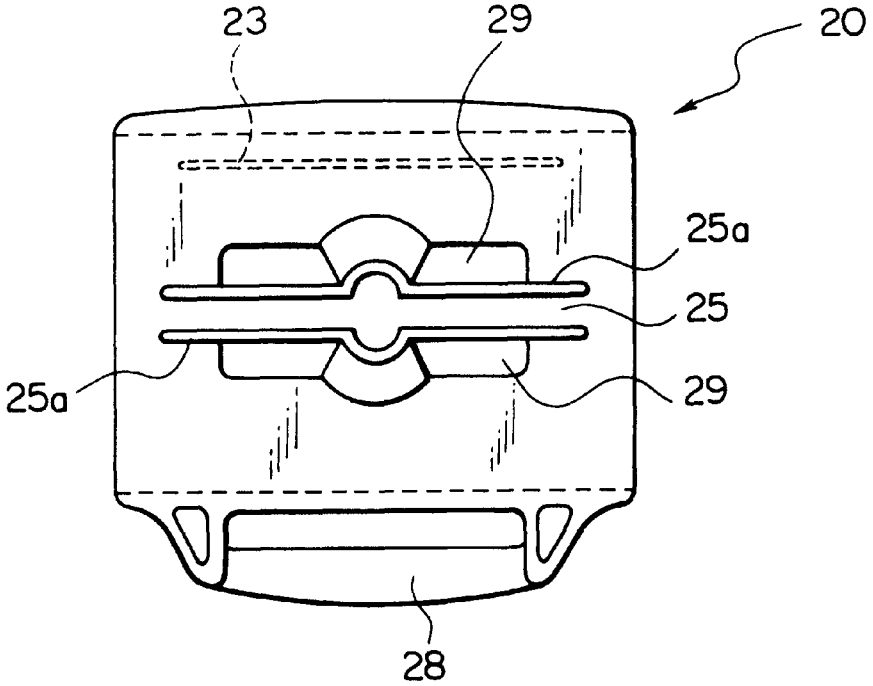
FIG. 9 is a rear view of the socket of the embodiment.
Figure 10:
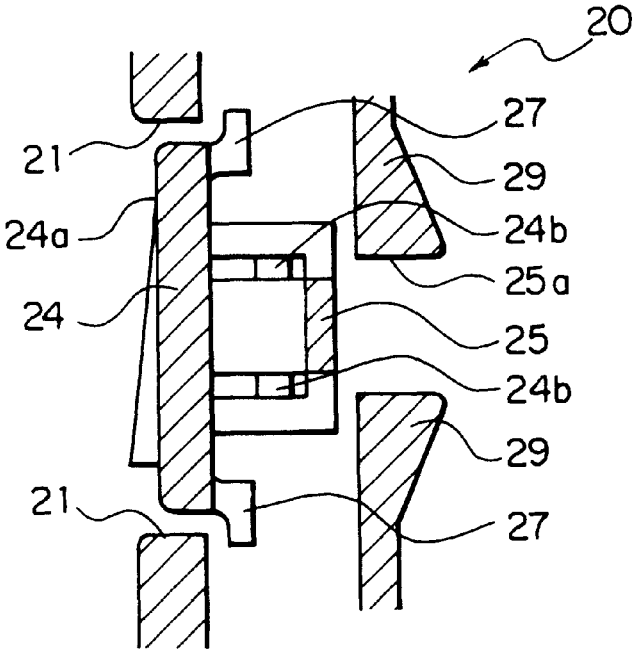
FIG. 10 is a sectional view of an operating portion of the socket taken along a line C—C in FIG. 7.

In an inner face of the inserting portions 22, two pairs of engaged portions 26 to be engaged with a pair of engaging portions 16 of each of the plug 10 are formed to project from an inner peripheral face of a front side of the socket 20, such that the pairs of the engaged portions 26 are arranged alternately to face each other. The engaged portions 26 are fixed to the inserting portions 22 of the socket 20 such that the engaged portions 26 do not overlap each other relative to the inserting directions of the plugs 10 of the inserting portions 22, as shown in FIG. 7. Furthermore, each the engaged portion 26 is defined with a slope 26*a* which slopes diagonally toward the rear face side relative to the inserting direction and which corresponds to a shape of the upper face 16*a* of each the engaging portion 16. In addition, each the engaged portion 26 is defined with an engaged face 26*b* which corresponds to a shape of the engaging face 16*b* of each the engaging portion 16 and which slopes slightly in the inserting direction of the plugs 10 from a face perpendicular to the inserting direction. A strap mounting portion 28 to be mounted with a strap 4 is formed on a side face of the socket 20 in a direction perpendicular to the plug inserting directions of the inserting portions 22.

Next, a method for manufacturing the buckle of the embodiment will be described below. First, the plugs 10 are molded simultaneously with the clamping portions 13 by a known injection molding. A slide core is positioned in a gap portion between each the elongated hole 12*c* and each of the opposite end portions 13*a* of the clamping portion 13, such that the clamping portion 13 is separated from the plug 10 after molding. The socket 20 is also molded by the known injection molding, wherein a pair of slide cores for forming the inserting portions 22 form opposite opening portions of the inserting portions 22 and tip ends of the slide cores form engaged portions 26. At this time, because the engaged portions 26 are positioned alternately in sliding directions of the pair of slide cores for forming the inserting portions 22, the engaged portions 26 projecting inside the inserting portions 22 can be formed by only sliding the sliding cores to the left and right. Thus, the engaged portions 26 can be easily formed by using a simple mold.

Figure 1:
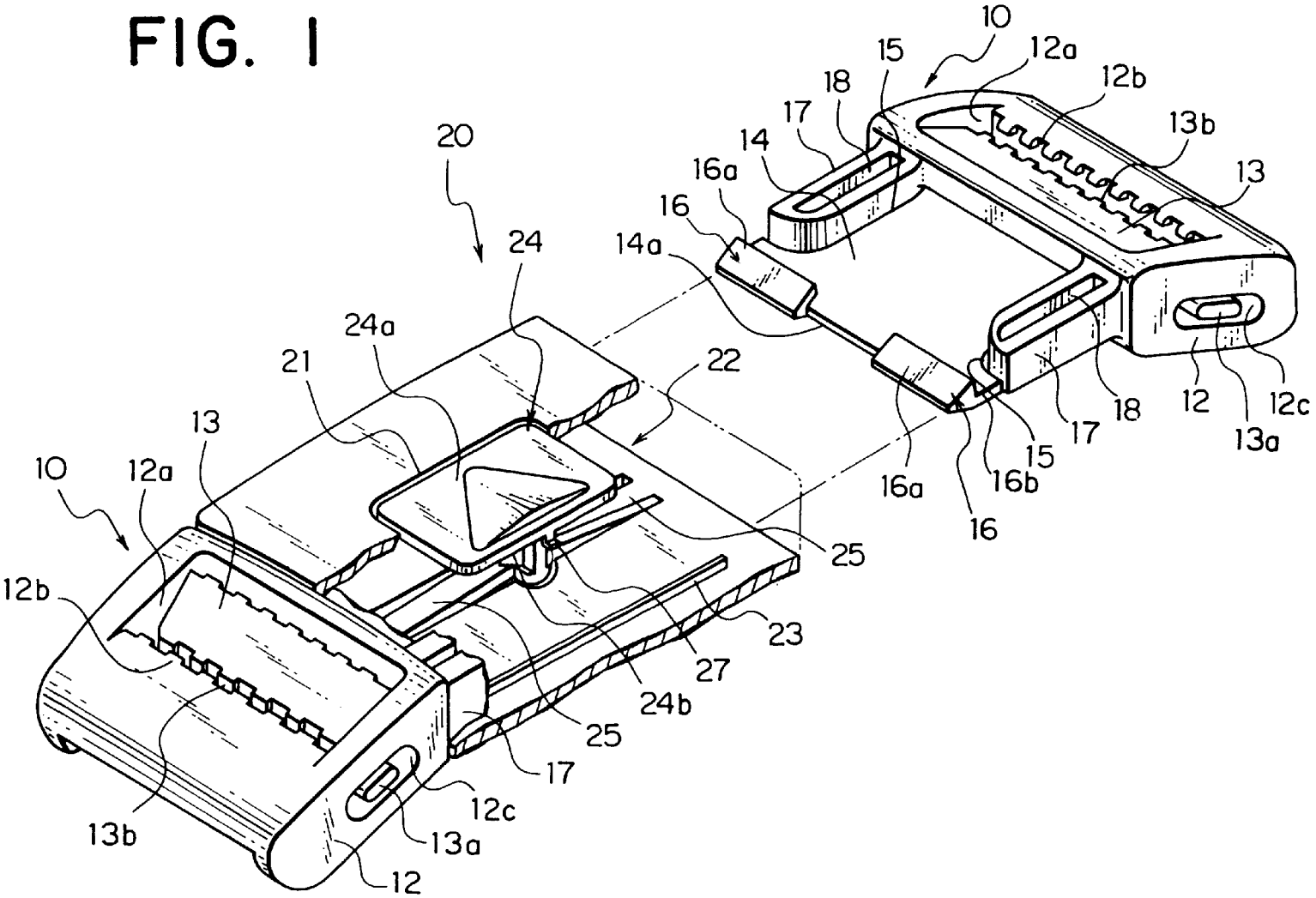
FIG. 1 is a partially cutaway perspective view of an embodiment of a buckle of the present invention.
Figure 5:
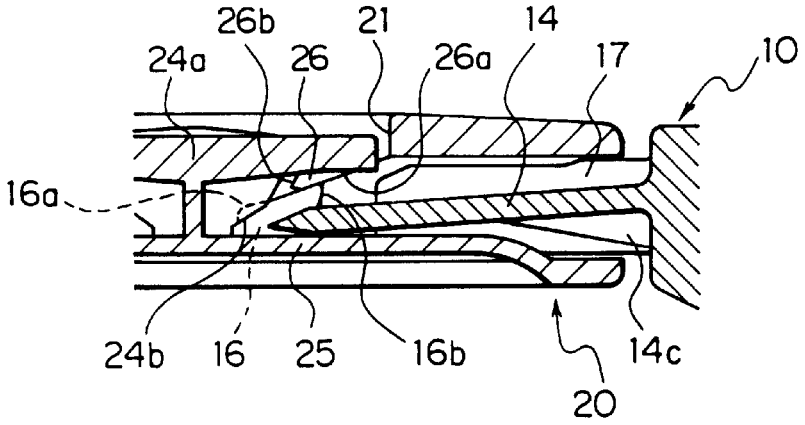
FIG. 5 is a sectional view of the buckle taken along a line A—A in FIG. 2 and in a state wherein the plugs are inserted into the socket.

Usage of the buckle of the embodiment will be described below. In order to mount the plug 10 into the socket 20, the tongue portion 14 is inserted into the inserting hole of the inserting portion 22, as shown in FIG. 1. At this time, the recessed grooves on the rear face side of the support portions 17 are guided by the projection streaks 23 of the inserting portion 22 so as to allow the tongue portion 14 to be smoothly inserted into the inserting portion 22. Then, the engaging portions 16 of the tongue portion 14 abut on the engaged portions 26. If the plug 10 is further pushed in this state, as shown in FIG. 5, the upper faces 16*a* of the engaging portions 16 are pushed down along the slopes 26*a* of the engaged portions 26. If the plug 10 is further pushed, the engaging portions 16 climb over the engaged portions 26 such that the engaging faces 16*b* face the engaged faces 26*b*, thereby completing engagement. This engagement is carried out by a temporary and resilient displacement of the engaging portions 16 relative to the engaged portions 26. Therefore, the pair of plugs 10 can be separately and reliably engaged with the socket 20.

Figure 6:
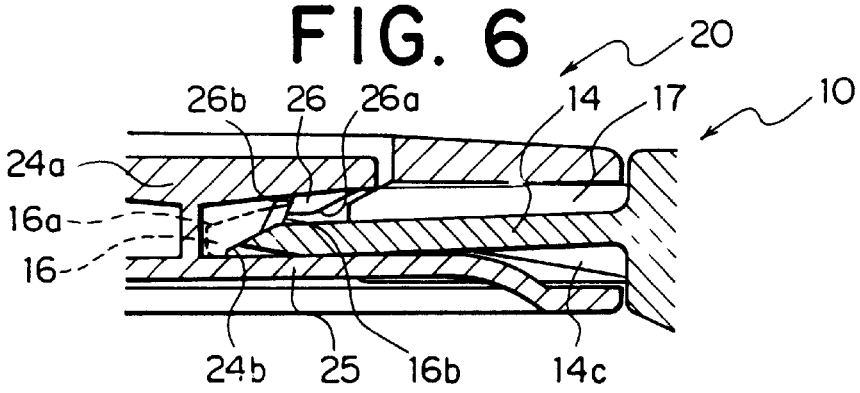
FIG. 6 is a sectional view of the buckle taken along a line A—A in FIG. 2 and in a state wherein the plugs are disengaged from the socket.

In order to disengage a coupling, by pushing the operating chip 24*a* of the operating portion 24, the pushing portions 24*b* push the tip end portions 14*a* of the tongue portions 14, thereby the tongue portions 14 resiliently deform toward the rear face side, as shown in FIG. 6. In this state, because the slopes of the pushing portions 24*b* are in resilient contact with the tip end portions 14*a* of the tongue portions 14, forces in a direction of the plugs 10 jumping out of the inserting portions 22 are applied to the plugs 10 due to the resilient forces and directions of the slopes. Thus, the engaging portions 16 and the engaged portions 26 are disengaged, thereby pushing the plugs 10 out of the socket 20. Because each the pushing portions 24*b* is formed to face the tip end portion 14*a* of the tongue portion 14, the pair of plugs 10 are simultaneously disengaged and the plugs 10 are pushed outward by pushing the operating chip 24*a*.

A strap 2 mounted to each the plug 10 of the embodiment is wound around the clamping portion 13 and reliably maintained between the mounting hole 12*a* of the strap mounting portion 12 and the clamping portion 13. At this time, if a base end portion side of the strap 2 is pulled, a counterclockwise moment acts on the clamping portion 13 such that the acute angle portions of the clamping portion 13 are pushed against an inner wall face of the mounting hole 12*a* and the serrated portions 12*b* and 13*a* of the strap mounting portion 12 and the clamping portion 13 clamp the strap 2 with the above moment, thereby further reliably maintaining the strap 2. Particularly, even if the strap 2 is pulled toward the rear face side of the strap mounting portion 12 away from the extending direction of the mounting portion 12, the strap 2 is not drawn out because a force in a direction to clamp the strap 2 between the clamping portion 13 and a side face of the mounting hole 12*a* is applied to the clamping portion 13 by a tension of the strap 2.

According to the buckle of the embodiment, the operating chip 24*a* descends evenly without tilting when the operating chip 24*a* is pushed down. Therefore, the tongue portions 14 of the pair of plugs 10 are pushed substantially simultaneously with the same force, thereby substantially simultaneously disengage the plugs 10 with the socket 20. Because the pair of plugs 10 jump out of the socket 20 substantially simultaneously, the buckle has a desirable operability and is easy to use. Furthermore, because there are two resilient portions 25, sufficient strength can be obtained. Because engaging projections 27 are formed on the operating chip 24*a*, the operating chip 24*a* does not stripped off outward from the operating hole 21 of the socket 20. Moreover, because projections 29 are formed on opposite side edge portions of the through holes 25*a* of the socket 20, the resilient portions 25 do not caught on clothes or a finger when the resilient portions 25 project to an outside of the socket 20, thereby preventing damage due to peeling, and thus, the buckle can be used safely.

The buckle of the invention is not limited to the above embodiment, but the tongue portions may have rigidity relative to the strap mounting portions, and the support portions may be resilient. In this case, when the plugs are inserted into the socket, the support portions are resiliently deformed and the plugs are inserted while swinging at the time of insertion. The resilient portion may have a both-end supported structure, a plurality of resilient portions may be formed or the resilient portion may be in a curved-line shape. Furthermore, the shapes of the operating portion, the engaging portions, the engaged portions, and the like can be properly determined, and the shapes of the tongue portions and the clamping portions are not limited to those in the above embodiment.

In the buckle of the invention, the operating chip evenly descends without tilting when the operating chip is pushed down. The pair of plugs are substantially simultaneously pushed with the same force, thereby substantially simultaneously disengage the plugs with the socket. Because the pair of plugs jump out of the socket substantially simultaneously, the buckle has a desirable operability. Furthermore, because the resilient portions have sufficient strength due to their both-end supported structure, the resilient portions are not easily deformed by external forces. Therefore, the buckle can be used safely and is comfortable to use.

Also, by forming projections projecting from the rear face side of the socket, it is possible to prevent the resilient portions from projecting toward the rear face side, being caught on something, and being peeled off, due to pushing operation of the resilient portions. Furthermore, the operating chip can be reliably prevented from being peeled off by the engaging projections of the operating chip.

What is claimed:

1. A buckle comprising a pair of plugs respectively mounted to end portions of a pair of straps, a socket mounted to an end portion of another strap, a strap mounting portion formed at a base portion of each of the plugs, a tongue portion formed to project from each strap mounting portion and to be inserted into the socket, an engaging portion formed at a tip end portion of each tongue portion, inserting portions which are formed in the socket to penetrate the socket and to face each other and into which the tongue portions are inserted respectively, fixed engaged portions which are formed in the inserting portions and with which the engaging portions of the plugs are engaged, and an operating portion which is formed between the engaged portions and which displaces the engaging portions to disengage the engaging portions with the engaged portions, wherein the operating portion comprises an operating chip exposed to an outer surface of the socket, pushing portions integrally formed on a rear face side of the operating chip, and a pair of resilient portions which connect to and extend from the operating chip and, integrally extend from a rear face side of the socket toward insides of the inserting portions, and are disposed symmetrically with respect to the operating chip.

2. A buckle according to claim 1, wherein the pair of resilient portions are stick-shaped and disposed on a straight line, end portions of the resilient portions which face each other are continuously formed to be connected to the operating chip, and other end portions of the resilient portions are continuously formed to be connected to a rear face of the socket.

3. A buckle according to claim 1, wherein the socket is defined in a vicinity of the resilient portions with through holes slightly larger than the resilient portions and is defined at side edge portions of the through holes with projections projecting toward the rear face side of the socket so as to surround the through holes.

4. A buckle according to claim 1, wherein the socket is defined with an operating hole into which the operating chip is fitted, and the operating chip is defined at an end edge portion thereof with an L-shaped engaging projection to be locked on a side edge portion of the operating hole.

* * * * *

UNITED STATES PATENT AND TRADEMARK OFFICE

CERTIFICATE OF CORRECTION

PATENT NO. : 6,170,133 B1
DATED : January 9, 2001
INVENTOR(S) : Ryoichiro Uehara It is certified that error appears in the above-identified patent and that said Letters Patent is hereby corrected as shown below:

Title page,
Item [57], line 4, ABSTRACT, "Each the" should read -- Each --.

Column 8, claim 1,
Line 6, "chip and," should read -- chip, and --.

Signed and Sealed this

Twenty-sixth Day of March, 2002

*Attest:*

*Attesting Officer*

JAMES E. ROGAN
*Director of the United States Patent and Trademark Office*